US008701878B2

(12) United States Patent
Spivey, Sr.

(10) Patent No.: US 8,701,878 B2
(45) Date of Patent: Apr. 22, 2014

(54) PACKAGE FOR BEVERAGE CONTAINERS

(75) Inventor: Raymond R. Spivey, Sr., Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 35 days.

(21) Appl. No.: 13/469,507

(22) Filed: May 11, 2012

(65) Prior Publication Data

US 2012/0285854 A1 Nov. 15, 2012

Related U.S. Application Data

(60) Provisional application No. 61/518,885, filed on May 13, 2011.

(51) Int. Cl.

| | |
|---|---|
| ***B65D 75/02*** | (2006.01) |
| ***B65D 85/00*** | (2006.01) |
| ***B66C 1/10*** | (2006.01) |
| ***B31B 1/26*** | (2006.01) |

(52) U.S. Cl.

USPC ..... 206/148; 206/427; 294/87.2; 493/162

(58) Field of Classification Search

USPC ..... 206/147–149, 151–153, 158, 427; 294/87.2, 87.28; 493/162

See application file for complete search history.

(56) References Cited

U.S. PATENT DOCUMENTS

| | | | |
|---|---|---|---|
| 1,527,399 | A | 2/1925 | Davidson |
| 1,925,102 | A | 9/1933 | Levkoff |
| 2,005,924 | A | 6/1935 | Wilson |
| 2,067,749 | A | 1/1937 | Zimmerman et al. |
| 2,115,673 | A | 4/1938 | Stompe |
| 2,331,038 | A | 4/1941 | Meller |
| 2,289,859 | A | 7/1942 | Arthur |
| 2,299,027 | A | 10/1942 | Novak |

(Continued)

FOREIGN PATENT DOCUMENTS

| | | | |
|---|---|---|---|
| CA | 873185 | A1 | 6/1971 |
| DE | 202 13 450 | U1 | 11/2002 |

(Continued)

OTHER PUBLICATIONS

International Search Report and Written Opinion for PCT/US2012/049272, mailed Dec. 14, 2012.

(Continued)

*Primary Examiner* — Bryon Gehman

(74) *Attorney, Agent, or Firm* — Womble Carlyle Sandridge & Rice, LLP

(57) ABSTRACT

A package comprising a carrier at least partially holding a container. The carrier comprises a top panel, a first outer side panel foldably connected to the top panel, a first inner side panel foldably connected to the first outer side panel, a second outer side panel foldably connected to the top panel, a second inner side panel foldably connected to the second outer side panel, a first bottom panel foldably connected to the first inner side panel, and a second bottom panel foldably connected to the second inner side panel. A container-receiving portion can comprise a first retaining feature in the first inner side panel and the first outer side panel and an opposing second retaining feature in the second inner side panel and the second outer side panel. A top portion of the container can be retained by the first and second retaining features.

33 Claims, 11 Drawing Sheets

(56) References Cited

U.S. PATENT DOCUMENTS 2,522,950 A 9/1950 Keith
2,669,351 A 2/1954 Carson et al.
2,754,047 A 7/1956 Schmidt et al.
2,798,603 A 7/1957 Grinspoon
2,950,041 A 8/1960 Stone
3,005,654 A 10/1961 Stone et al.
3,075,799 A * 1/1963 Weiss ..... 294/87.2
3,078,032 A 2/1963 Robinson et al.
3,128,010 A 4/1964 Forrer
3,133,634 A 5/1964 Bozdar
3,137,109 A 6/1964 Rapata
3,156,358 A 11/1964 Randrup
3,175,682 A 3/1965 Forrer
3,178,242 A 4/1965 Ellis et al.
3,228,582 A 1/1966 Osberg
3,263,861 A 8/1966 Carr
3,265,283 A 8/1966 Farquhar
3,300,115 A 1/1967 Schauer
3,332,594 A 7/1967 De Capua
3,346,167 A 10/1967 Schmidt
3,356,279 A 12/1967 Root
3,363,928 A 1/1968 Haufe et al.
3,414,313 A 12/1968 Schwarz
3,503,498 A 3/1970 Lawrence
3,517,858 A 6/1970 Farquhar
3,528,697 A 9/1970 Wood
3,533,549 A 10/1970 Gilchrist
3,540,581 A 11/1970 Koolnis
3,601,439 A 8/1971 Poupitch
3,627,121 A 12/1971 Deasy
3,653,503 A 4/1972 Arneson
3,701,416 A 10/1972 Lawrence
3,722,945 A 3/1973 Wood
3,752,305 A 8/1973 Heyne
3,897,873 A 8/1975 Graser
3,942,631 A 3/1976 Sutherland et al.
4,029,204 A 6/1977 Manizza
4,155,449 A 5/1979 Bryne
4,192,540 A 3/1980 Oliff
4,214,660 A 7/1980 Hunt, Jr.
4,216,861 A 8/1980 Oliff
4,222,485 A 9/1980 Focke
4,256,226 A 3/1981 Stone
4,304,329 A 12/1981 Graser
4,305,500 A 12/1981 Jaeschke
4,318,474 A 3/1982 Hasegawa
4,326,628 A 4/1982 Wood
4,336,898 A 6/1982 Joyce
4,364,509 A 12/1982 Holley, Jr. et al.
4,372,599 A 2/1983 Kiedaisch et al.
4,375,258 A 3/1983 Crayne et al.
4,376,509 A 3/1983 Schaffer
4,378,877 A 4/1983 Botterman et al.
4,378,879 A 4/1983 Killy
4,382,505 A 5/1983 Sutherland et al.
4,396,143 A 8/1983 Killy
4,398,636 A 8/1983 Baxter
4,417,655 A 11/1983 Forbes, Jr.
4,417,661 A 11/1983 Roccaforte
4,566,591 A 1/1986 Turtschan et al.
4,577,762 A 3/1986 Kuchenbecker
4,605,128 A 8/1986 Rieke
4,658,984 A 4/1987 Brunner
4,703,847 A 11/1987 Oliff
4,807,751 A 2/1989 Klygis et al.
4,817,866 A 4/1989 Wonnacott
4,890,440 A 1/1990 Romagnoli
4,949,845 A 8/1990 Dixon
4,974,771 A 12/1990 Lavery
5,101,642 A 4/1992 Alexandrov
5,103,971 A 4/1992 Schuster
5,137,211 A 8/1992 Summer et al.
5,139,147 A 8/1992 Sutherland
5,163,548 A 11/1992 Domansky
5,188,225 A 2/1993 Jorba
5,201,412 A 4/1993 Schuster et al.
5,219,229 A 6/1993 Sengewald
5,234,103 A 8/1993 Schuster
5,246,113 A 9/1993 Schuster
5,249,681 A 10/1993 Miller
5,267,644 A 12/1993 Tsao
5,297,673 A 3/1994 Sutherland
5,310,050 A 5/1994 Sutherland
5,310,051 A 5/1994 Sutherland
5,318,178 A 6/1994 Davies et al.
5,323,895 A 6/1994 Sutherland et al.
5,328,024 A 7/1994 Sutherland
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,390,784 A 2/1995 Sutherland
5,407,065 A 4/1995 Sutherland
5,425,474 A 6/1995 Dalea et al.
5,443,153 A 8/1995 Sutherland
5,445,262 A 8/1995 Sutherland
5,452,799 A 9/1995 Sutherland
5,476,170 A 12/1995 Weber
5,482,185 A 1/1996 McNaughton
5,484,059 A 1/1996 Sutherland
5,503,267 A 4/1996 Sutherland
5,505,372 A 4/1996 Edson et al.
5,520,283 A 5/1996 Sutherland
5,524,756 A 6/1996 Sutherland
5,551,566 A 9/1996 Sutherland
5,553,705 A 9/1996 Bakx
5,577,612 A 11/1996 Chesson et al.
5,593,027 A 1/1997 Sutherland
5,597,114 A 1/1997 Kramedjian et al.
5,620,094 A 4/1997 Naumann
5,622,309 A 4/1997 Matsuda et al.
5,664,683 A 9/1997 Brody
5,667,070 A 9/1997 Miret
5,687,838 A 11/1997 Bakx
5,690,213 A 11/1997 Matsumura
5,690,230 A 11/1997 Griffith
5,706,936 A 1/1998 Bernstein
5,711,419 A 1/1998 Beales et al.
5,746,310 A 5/1998 Slomski
5,791,463 A 8/1998 Negelen
5,794,778 A 8/1998 Harris
5,816,391 A 10/1998 Harris
5,820,185 A 10/1998 Gomes
5,826,783 A 10/1998 Stout
5,875,961 A 3/1999 Stone et al.
5,881,884 A 3/1999 Podosek
5,921,392 A 7/1999 Davis
5,921,398 A 7/1999 Carroll
5,924,559 A 7/1999 Carrel et al.
5,927,498 A 7/1999 Saam
5,960,945 A 10/1999 Sutherland
6,039,181 A 3/2000 Whiteside
6,050,402 A 4/2000 Walter
6,059,099 A 5/2000 Galbierz
6,176,419 B1 1/2001 Holley, Jr.
6,223,892 B1 5/2001 Bakx
6,241,083 B1 6/2001 Harrelson
6,283,293 B1 9/2001 Lingamfelter
6,315,111 B1 11/2001 Sutherland
6,394,272 B1 5/2002 Domansky
6,409,077 B1 6/2002 Telesca et al.
D459,927 S 7/2002 Flowers et al.
6,478,219 B1 11/2002 Holley, Jr.
6,484,903 B2 11/2002 Spivey et al.
6,488,322 B2 12/2002 Bakx
6,550,615 B2 4/2003 Lingamfelter
6,557,699 B1 5/2003 Focke et al.
6,578,736 B2 6/2003 Spivey
6,604,677 B1 8/2003 Sutherland et al.
6,669,083 B2 12/2003 Bates
6,715,639 B2 4/2004 Spivey
6,752,262 B1 6/2004 Boriani et al.
6,789,673 B2 9/2004 Lingamfelter

(56) References Cited

U.S. PATENT DOCUMENTS

| | | | |
|---|---|---|---|
| 6,866,186 | B2 | 3/2005 | Fogle et al. |
| 6,866,188 | B2 | 3/2005 | Harrelson |
| 6,896,130 | B2 | 5/2005 | Theelen |
| 6,902,104 | B2 | 6/2005 | Holley, Jr. et al. |
| 6,918,487 | B2 | 7/2005 | Harrelson |
| 6,929,172 | B2 | 8/2005 | Bates et al. |
| 6,945,450 | B2 | 9/2005 | Rusnock |
| 6,968,992 | B2 | 11/2005 | Schuster |
| 6,969,172 | B2 | 11/2005 | Actis-Datta |
| 6,974,072 | B2 | 12/2005 | Harrelson |
| 6,991,107 | B2 | 1/2006 | Harrelson |
| 6,997,316 | B2 | 2/2006 | Sutherland |
| 7,000,803 | B2 | 2/2006 | Miller |
| 7,011,209 | B2 | 3/2006 | Sutherland et al. |
| 7,083,046 | B2 | 8/2006 | Bakx |
| 7,104,435 | B2 | 9/2006 | Holley, Jr. |
| 7,134,593 | B2 | 11/2006 | Harrelson |
| 7,163,103 | B2 | 1/2007 | Bakx et al. |
| 7,168,558 | B2 | 1/2007 | Harrelson |
| 7,225,930 | B2 | 6/2007 | Ford et al. |
| 7,240,789 | B2 | 7/2007 | Sutherland |
| 7,264,114 | B2 | 9/2007 | Daniel |
| 7,374,038 | B2 | 5/2008 | Smalley |
| 7,690,507 | B2 | 4/2010 | Sutherland |
| 7,721,878 | B2 | 5/2010 | Requena |
| 7,766,181 | B2 * | 8/2010 | Fogle et al. ..... 229/404 |
| 7,789,231 | B2 | 9/2010 | Requena |
| 7,823,721 | B2 | 11/2010 | Sutherland et al. |
| 8,056,709 | B2 | 11/2011 | Sutherland |
| 8,061,519 | B2 | 11/2011 | Taglione |
| 8,096,413 | B2 | 1/2012 | DePaula |
| 8,162,135 | B2 | 4/2012 | Oliveira |
| 2002/0029991 | A1 | 3/2002 | Lingamfelter |
| 2002/0070139 | A1 | 6/2002 | Bates |
| 2002/0088820 | A1 | 7/2002 | Spivey |
| 2002/0088821 | A1 | 7/2002 | Spivey et al. |
| 2002/0185499 | A1 | 12/2002 | Harrelson et al. |
| 2002/0195371 | A1 | 12/2002 | Brown |
| 2003/0080004 | A1 | 5/2003 | Olsen et al. |
| 2003/0141313 | A1 | 7/2003 | Bates |
| 2003/0150759 | A1 | 8/2003 | White, Jr. |
| 2003/0192907 | A1 | 10/2003 | Bates |
| 2003/0213705 | A1 | 11/2003 | Woog |
| 2004/0011674 | A1 | 1/2004 | Theelen |
| 2004/0060972 | A1 | 4/2004 | Harrelson |
| 2004/0089575 | A1 | 5/2004 | Lingamfelter |
| 2004/0089671 | A1 | 5/2004 | Miller |
| 2004/0099558 | A1 | 5/2004 | Oliff et al. |
| 2004/0155098 | A1 | 8/2004 | Harrelson |
| 2004/0188277 | A1 | 9/2004 | Auclair |
| 2004/0188300 | A1 | 9/2004 | Sutherland |
| 2004/0226833 | A1 | 11/2004 | Daniel |
| 2005/0023170 | A1 | 2/2005 | Lingamfelter |
| 2005/0092820 | A1 | 5/2005 | Chekroune |
| 2005/0103650 | A1 | 5/2005 | Auclair et al. |
| 2005/0126947 | A1 | 6/2005 | Holley |
| 2005/0127151 | A1 | 6/2005 | Johnson |
| 2005/0178791 | A1 | 8/2005 | Miller |
| 2005/0189405 | A1 | 9/2005 | Gomes et al. |
| 2005/0224565 | A1 | 10/2005 | Holley |
| 2006/0054522 | A1 | 3/2006 | Kline et al. |
| 2006/0091193 | A1 | 5/2006 | DeBusk et al. |
| 2006/0118606 | A1 | 6/2006 | Holley, Jr. et al. |
| 2006/0131370 | A1 | 6/2006 | Bates |
| 2006/0175386 | A1 | 8/2006 | Holley, Jr. |
| 2008/0121536 | A1 | 5/2008 | Miret et al. |
| 2008/0135423 | A1 | 6/2008 | Oliveira |
| 2009/0101526 | A1 | 4/2009 | Sutherland et al. |
| 2009/0127147 | A1 | 5/2009 | Sutherland |
| 2010/0264043 | A1 | 10/2010 | De Paula |
| 2011/0000799 | A1 | 1/2011 | Gonzalez |
| 2011/0284623 | A1 | 11/2011 | Jones et al. |
| 2012/0080328 | A1 | 4/2012 | De Paula |
| 2012/0138489 | A1 | 6/2012 | Holley et al. |

FOREIGN PATENT DOCUMENTS

| | | | |
|---|---|---|---|
| EP | 0 066 029 | A1 | 12/1992 |
| EP | 0 636 554 | A2 | 2/1995 |
| EP | 0806372 | | 6/1997 |
| EP | 1 384 679 | A1 | 1/2004 |
| FR | 2 549 010 | | 1/1985 |
| GB | 2 264 101 | A | 8/1993 |
| JP | 2003-146359 | | 5/2003 |
| WO | WO 93/25439 | A1 | 12/1993 |
| WO | WO 96/29260 | | 9/1996 |
| WO | WO 98/49071 | A1 | 11/1998 |
| WO | WO 99/64301 | | 12/1999 |
| WO | WO 00/03937 | | 1/2000 |
| WO | WO 02/47990 | A2 | 6/2002 |
| WO | WO 2004/043790 | A2 | 5/2004 |
| WO | WO 2005/051781 | A1 | 6/2005 |
| WO | WO 2006/050210 | A2 | 5/2006 |
| WO | WO 2006/050316 | A1 | 5/2006 |
| WO | WO2007089844 | | 8/2007 |

OTHER PUBLICATIONS

ISR/WO for related PCT application No. PCT/US2011/063029 mailed Jul. 30, 2012.

ISR/WO for related PCT application No. PCT/US2012/037461 mailed Nov. 14, 2012.

* cited by examiner

PACKAGE FOR BEVERAGE CONTAINERS

CROSS-REFERENCE TO RELATED APPLICATIONS

This application claims the benefit of U.S. Provisional Patent Application No. 61/518,885, filed May 13, 2011.

INCORPORATION BY REFERENCE

The disclosure of U.S. Provisional Patent Application No. 61/518,885, which was filed on May 13, 2011, is hereby incorporated by reference for all purposes as if presented herein in its entirety.

BACKGROUND OF THE DISCLOSURE

The present disclosure generally relates to cartons for holding and dispensing beverage containers, cans, or other types of articles. More specifically, the present disclosure relates to cartons that clip onto at least a portion of one or more containers.

SUMMARY OF THE DISCLOSURE

In general, one aspect of the disclosure is generally directed to a package comprising a carrier at least partially holding at least one container. The at least one container can comprise a top portion and a body portion. The carrier comprises a top panel, a first outer side panel foldably connected to the top panel, a first inner side panel foldably connected to the first outer side panel, a second outer side panel foldably connected to the top panel, a second inner side panel foldably connected to the second outer side panel, a first bottom panel foldably connected to the first inner side panel, and a second bottom panel foldably connected to the second inner side panel. At least one container-receiving portion can comprise a first retaining feature extending in at least one of the first inner side panel and the first outer side panel and an opposing second retaining feature extending in at least one of the second inner side panel and the second outer side panel. The top portion of the at least one container can be at least partially retained by at least one of the first retaining feature and the second retaining feature. Each of the first bottom panel and the second bottom panel is at least partially disposed between the top panel and the top portion of the at least one container.

In another aspect, the disclosure is generally directed to a blank for forming a carrier for at least partially holding at least one container. The at least one container can comprise a top portion and a body portion. The blank comprises a top panel, a first outer side panel foldably connected to the top panel, a first inner side panel foldably connected to the first outer side panel, a second outer side panel foldably connected to the top panel, a second inner side panel foldably connected to the second outer side panel, a first bottom panel foldably connected to the first inner side panel, and a second bottom panel foldably connected to the second inner side panel. The blank can further comprise receiving features for forming at least one container-receiving portion in the carrier formed from the blank. The receiving features comprise a first retaining feature extending in at least one of the first inner side panel and the first outer side panel and an opposing second retaining feature extending in at least one of the second inner side panel and the second outer side panel. At least one of the first retaining feature and the second retaining feature can be for at least partially retaining the top portion of the at least one container in the carrier formed from the blank. At least a portion of each of the first bottom panel and the second bottom panel is for being at least partially disposed between the top panel and the top portion of the at least one container when the carrier is formed from the blank.

In another aspect, the disclosure is generally directed to a method of forming a package. The method comprises obtaining a blank comprising a top panel, a first outer side panel foldably connected to the top panel, a first inner side panel foldably connected to the first outer side panel, a second outer side panel foldably connected to the top panel, a second inner side panel foldably connected to the second outer side panel, a first bottom panel foldably connected to the first inner side panel, a second bottom panel foldably connected to the second inner side panel, and receiving features comprising a first retaining feature extending in at least one of the first inner side panel and the first outer side panel and an opposing second retaining feature extending in at least one of the second inner side panel and the second outer side panel. The method can further comprise forming a carrier having an interior and at least one container-receiving portion by folding the blank so that the first bottom panel and the second bottom panel are at least partially overlapped opposite to the top panel. The at least one container-receiving portion can comprise the first retaining feature and the second retaining feature. The method can further comprise positioning at least one container to be respectfully received in the at least one container-receiving portion with at least a portion of the first bottom panel and the second bottom panel being disposed between the top panel and a top portion of the at least one container.

Other aspects, features, and details of the present disclosure can be more completely understood by reference to the following detailed description, taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded ore reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to carriers, constructs, sleeves, cartons, or the like, and packages for holding and displaying containers such as cups, jars, bottles, cans, etc. The containers can be used for packaging food and beverage products, for example. The containers can be made from materials suitable in composition for packaging the particular food or beverage item, and the materials include, but are not limited to, glass and the like; plastics such as PET, LDPE, LLDPE, HDPE, PP, PS, PVC, EVOH, and Nylon; aluminum and/or other metals; or any combination thereof.

Carriers according to the present disclosure can accommodate containers of numerous different shapes. For the purpose of illustration and not for the purpose of limiting the scope of the disclosure, the following detailed description describes food product containers (e.g., glass jars, plastic containers, or aluminum cans) at least partially disposed within the carrier embodiments. In this specification, the terms "lower," "bottom," "upper," "top," "outer," and "inner" indicate orientations determined in relation to fully erected carriers or packages.

Figure 1:
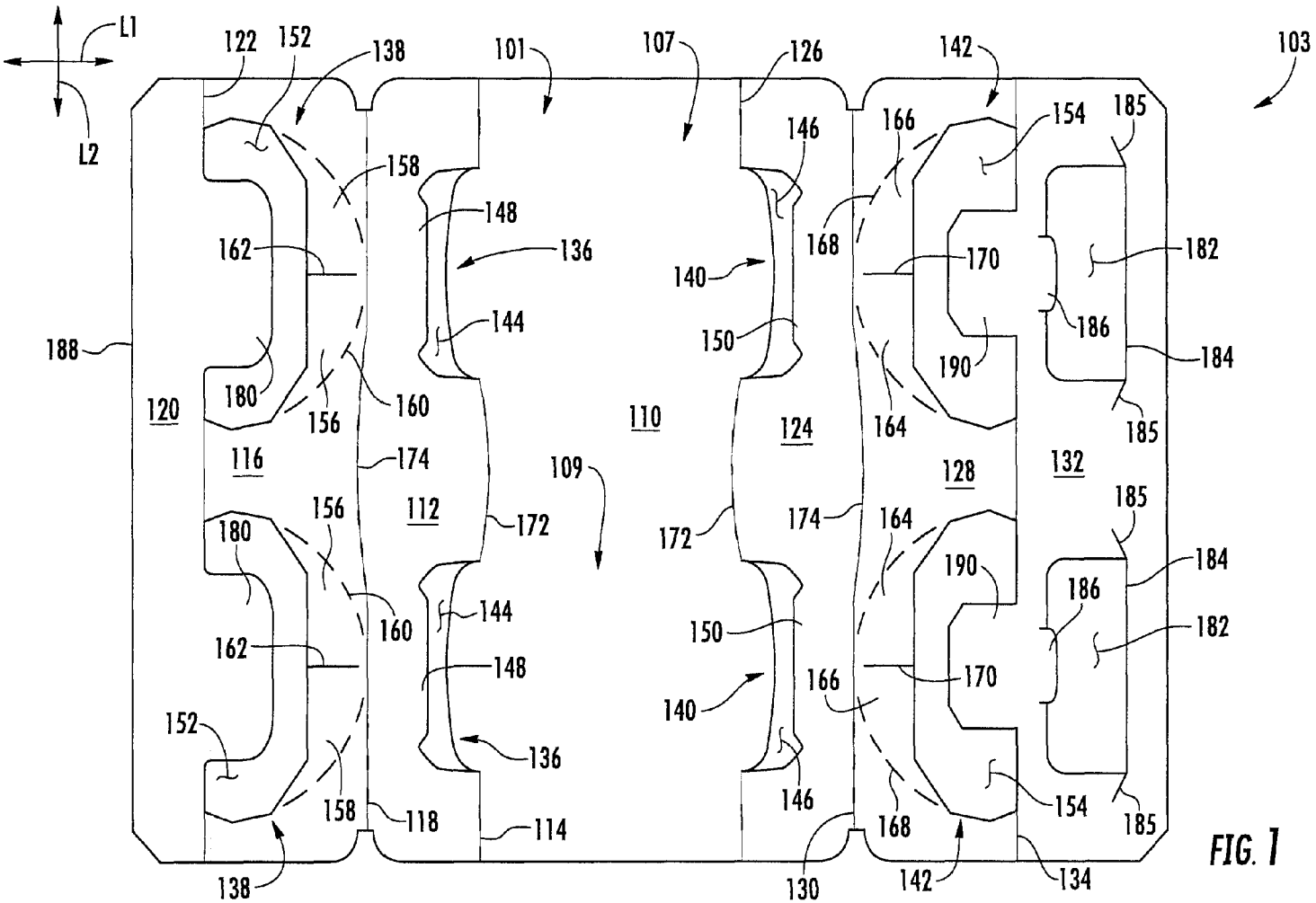
FIG. 1 is a plan view of a blank used to form a carrier according to a first embodiment of the disclosure.

FIG. 1 is a plan view of an exterior side 101 of a blank 103 used to form a carton or carrier 105 (FIG. 2) according to a first embodiment of the disclosure. The blank 103 has a longitudinal axis L1 and a lateral axis L2. The carrier 105 is illustrated in its erected state in FIGS. 3-6, in which it is attached to upper portions of containers C, forming a package 106. Each of the containers C can be at least partially retained in a respective container-receiving portion 107, 109 (alternatively: container receivers 107, 109). In the illustrated embodiments the containers C are illustrated as glass jars having a top portion or lid L and a bottom portion or body B; however, other containers may be held in the package 106 without departing from the disclosure. In one embodiment, the lids L of the containers C comprise rims R that extend outwardly from the containers C. Alternatively, the rim R can be a chime extending from an upper portion of an alternative container (e.g., the containers C2 of FIGS. 10-12). The upper portions and rim portions of the containers can be otherwise configured or omitted without departing from the disclosure. As shown in FIG. 1, the blank 103 may be wholly or partially symmetric about a longitudinal axis L1. Therefore, certain elements in the drawing figures share common or similar reference numerals in order to reflect the whole and/or partial symmetries.

Referring to FIG. 1, the blank 103 comprises a top panel 110 foldably connected to a first outer side panel 112 at a first transverse fold line 114, a first inner side panel 116 foldably connected to the first outer side panel 112 at a second transverse fold line 118, a first bottom panel 120 foldably connected to the first inner side panel 116 at a third transverse fold line 122, a second outer side panel 124 foldably connected to the top panel 110 at a fourth transverse fold line 126, a second inner side panel 128 foldably connected to the second outer side panel 124 at a fifth transverse fold line 130, and a second bottom panel 132 foldably connected to the second inner side panel 128 at a sixth transverse fold line 134.

One or more cuts may be included in one or more of the transverse fold lines 114, 118, 122, 126, 130, 134 to facilitate folding along the fold lines. Any number of cuts may be formed in any of the fold lines, and the number and length of the cuts may be selected according to, for example, the gauge and/or the stiffness of the material used to form the blank 103. The fold lines 114, 118, 122, 126, 130, 134 may be formed by other methods (e.g., crease lines without cuts) without departing from the disclosure.

In the illustrated embodiment, the two container-receiving portions 107, 109 are arranged in a single row. Each container-receiving portion 107, 109 is shaped and sized to receive at least the lid L of one of the containers C that is to be held within the erected carrier 105. In the exemplary embodiment, two containers C are accommodated in the erected carrier 105, forming the 1×2 package 106. Other package configurations, such as 1×3, 1×4, or 2×2, etc. are also within the scope of the present disclosure. Each container-receiving portion 107, 109 includes a first outer retaining feature 136 extending in the first outer side panel 112, a first inner retaining feature 138 extending in the first inner side panel 116, a second outer retaining feature 140 extending in the second outer side panel 124, and a second inner retaining feature 142 extending in the second inner side panel 128. In one embodiment, the first outer retaining feature 136 and the first inner retaining feature 138 of each container-receiving portion 107, 109 can, collectively, comprise a first retaining feature, and the second outer retaining feature 140 and the second inner retaining feature 142 of each container-receiving portion 107, 109 can, collectively, comprise a second retaining feature. In one embodiment, the retaining features can, collectively or in part, comprise receiving features or container receiver features in the blank 103 for forming the container receivers 107, 109.

As shown in FIG. 1, each of the first and second outer retaining features 136, 140 includes a respective outer opening 144, 146 adjacent the top panel 110 and a respective outer retention tab 148, 150 extending from the respective outer side panel 112, 124. A curved portion of the top panel 110 can extend into the opening for covering a portion of the lid L of a container C in the package 106. Each of the first and second inner retaining features 138, 142 includes a respective inner opening 152, 154 adjacent the respective bottom panel 120, 132. Additionally, each of the first inner retaining features 138 can include two inner retention flaps 156, 158 that are foldably connected to the first inner side panel 116 along an arcuate fold line 160 and separable along a longitudinal cut 162. Each of the second inner retaining features 142 can include two inner retention flaps 164, 166 that are foldably connected to the second inner side panel 128 along an arcuate fold line 168 and separable along a longitudinal cut 170. Alternatively, the first container-receiving portion 107 and/or the second container-receiving portion 109 can be omitted or otherwise shaped, arranged, positioned, and/or configured without departing from the disclosure.

Figure 3:
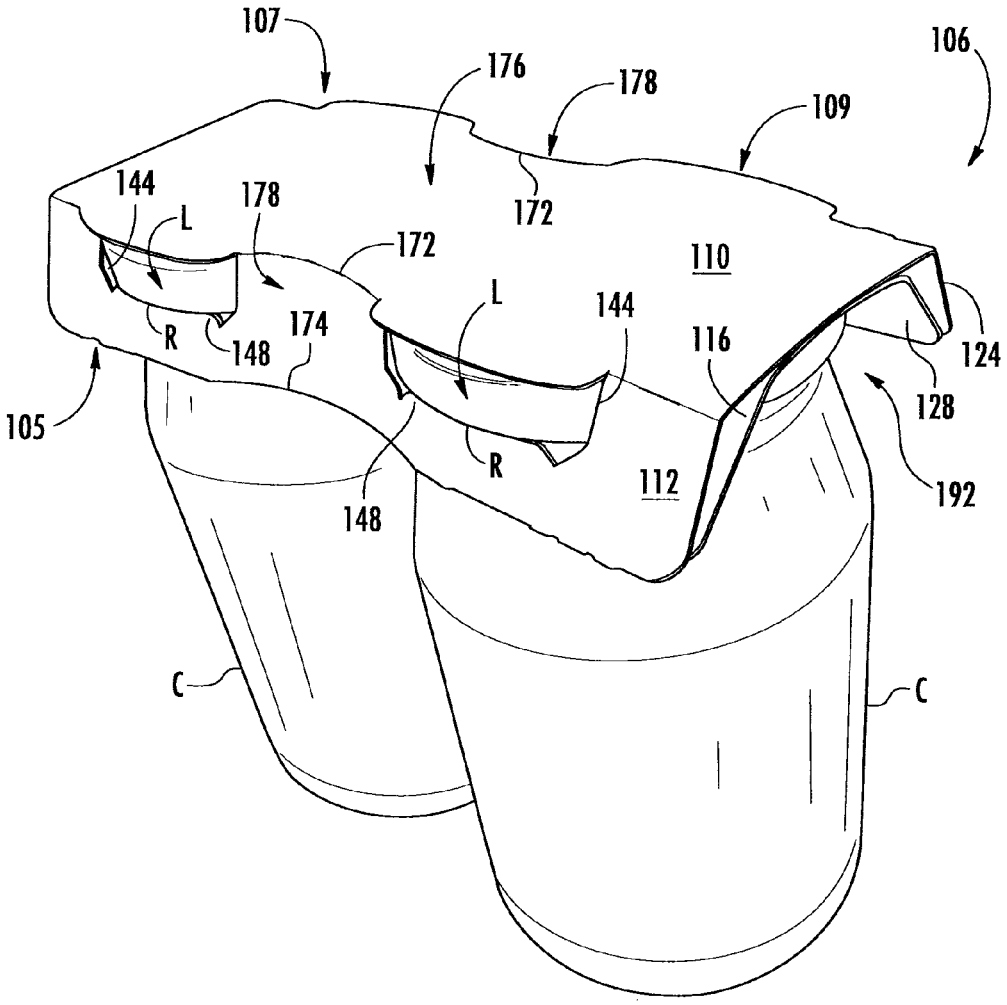
FIG. 3 is a perspective view of the carrier of FIG. 2 holding containers to form a package according to the first embodiment of the disclosure.
Figure 4:
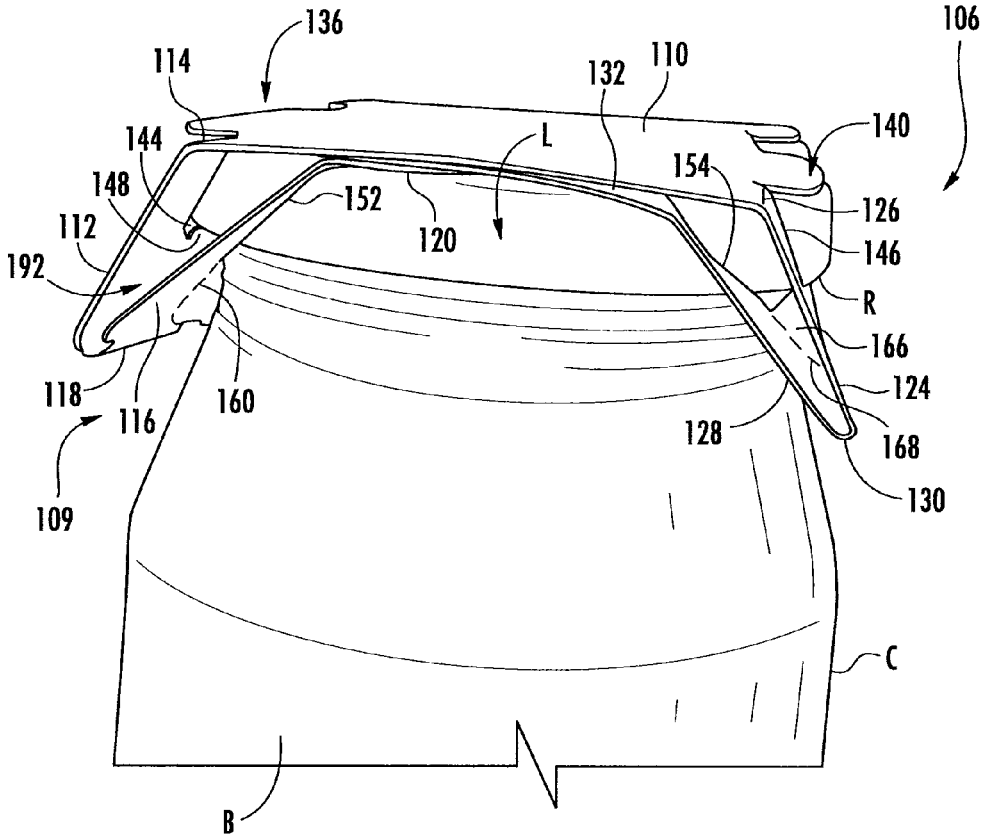
FIG. 4 is a perspective end view of the package of FIG. 3.
Figure 5:
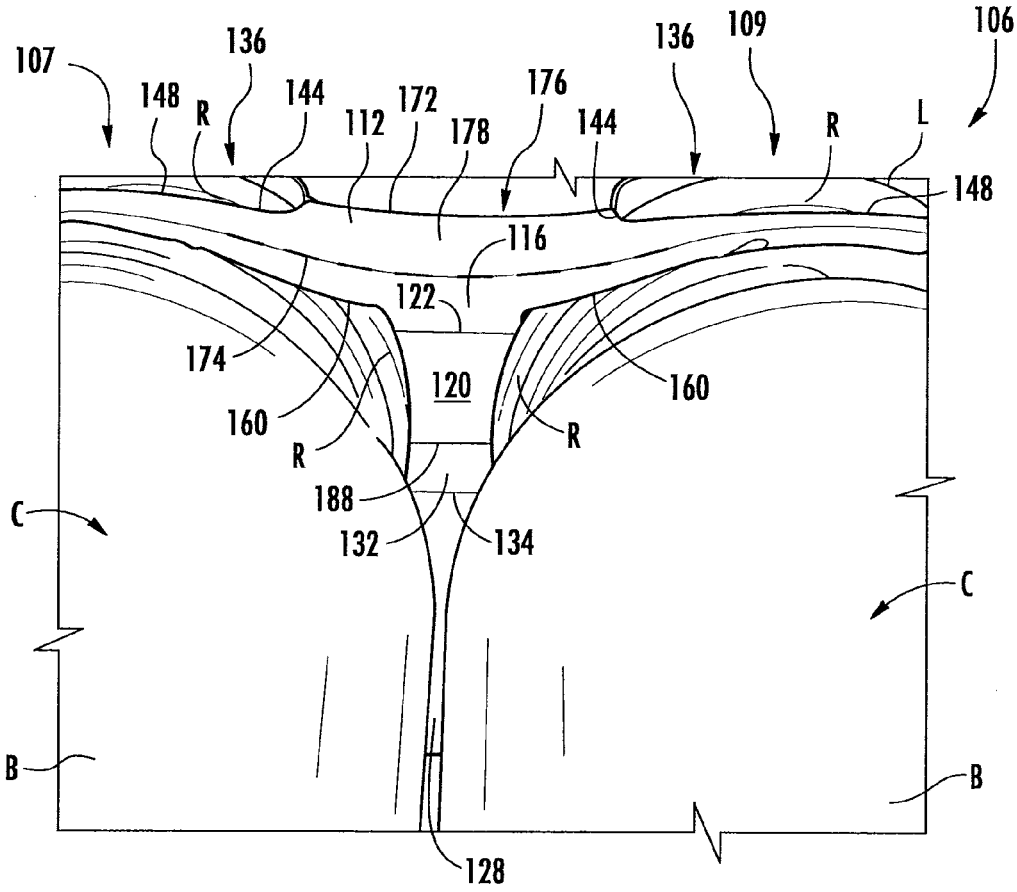
FIG. 5 is a perspective view of an underside of a portion of the package of FIG. 3.
Figure 6:
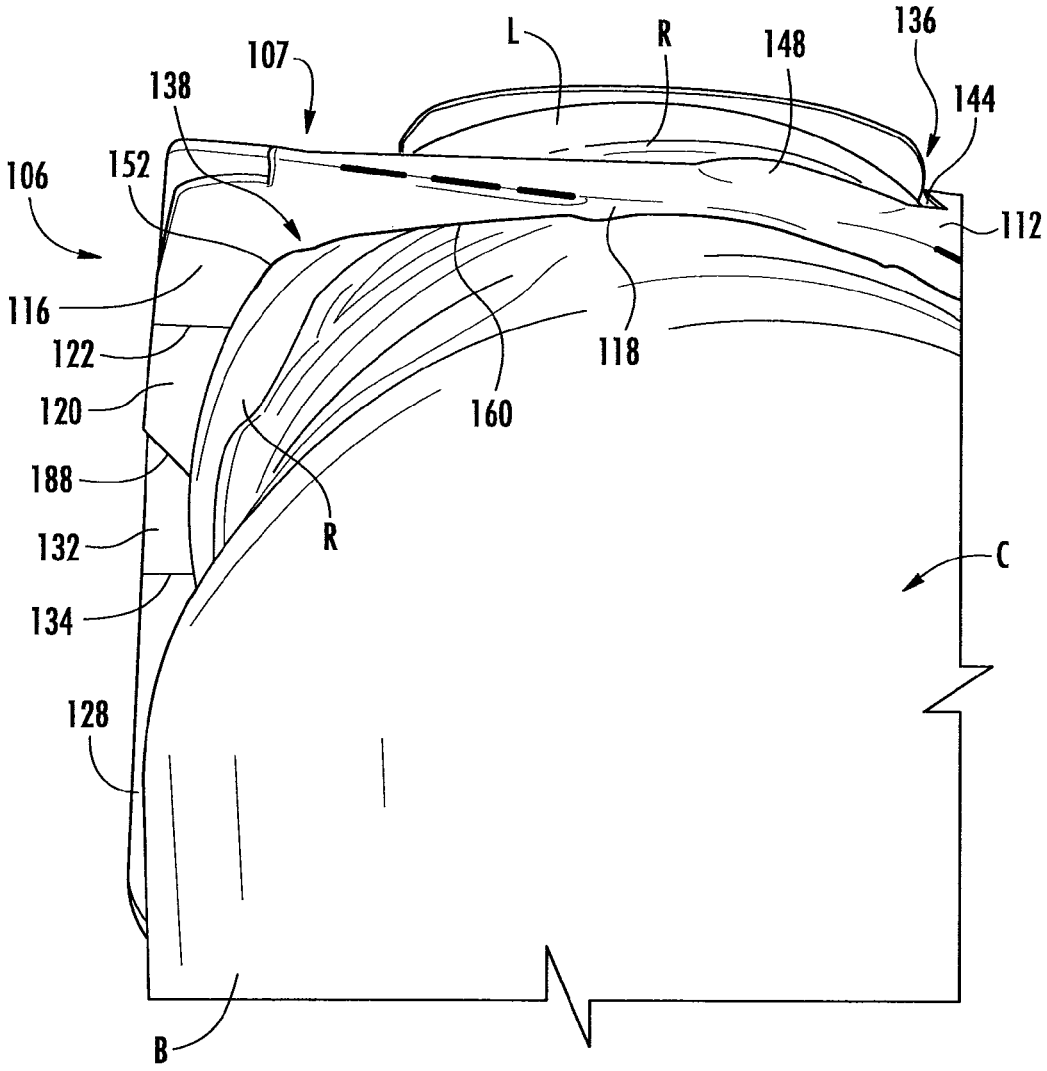
FIG. 6 is a perspective view of an underside of another portion of the package of FIG. 3.

As shown in FIG. 1, each of the first and fourth transverse fold lines 114, 126 can include an arcuate center portion 172 curving into the top panel 110, and each of the second and fifth transverse fold lines 118, 130 can include an arcuate center portion 174 curving into the respective inner side panel 116, 128. The arcuate center portions 172, 174 form a curved portion 178 (FIGS. 3 and 5) in the outer side panels 112, 124 to provide a gripping area 176 between the container-receiving portions 107, 109 and to help the side panels conform to the shape of the containers C (FIGS. 3, 5, and 6).

Figure 2:
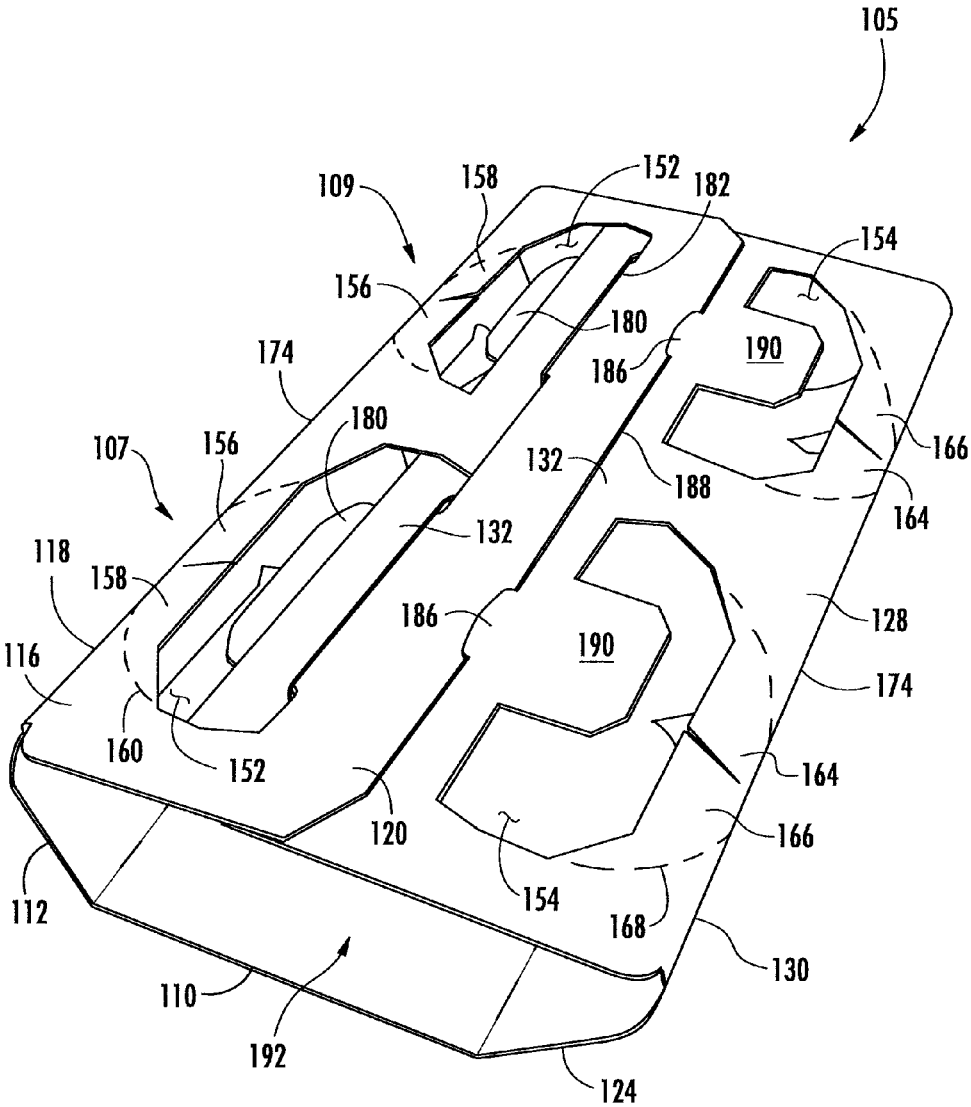
FIG. 2 is a perspective view of the carrier formed from the blank of FIG. 1 according to the first embodiment of the disclosure.

According to the illustrated embodiment, the blank 103 can include locking features for interlocking the bottom panels 120, 132 in the carrier 105 (FIG. 2). Accordingly, the first bottom panel 120 can include a primary locking tab 180 adjacent each of the inner openings 152, and the second bottom panel 132 can include two corresponding locking apertures 182 that are generally aligned with the respective primary locking tabs 180. Each of the locking apertures 182 can include a tab-receiving edge 184 and a secondary locking tab 186 disposed opposite to the tab-receiving edge 184. The secondary locking tabs 186 can extend into the respective locking apertures 182 and can be defined by longitudinal cuts in the second bottom panel 132. Oblique cuts 185 can extend in the second bottom panel 132 from the ends of the tab-receiving edges 184. Accordingly, the first bottom panel 120 can overlap the second bottom panel 132 so that the primary locking tabs 180 can engage the tab-receiving edges 184 of the respective locking apertures 182 and the secondary locking tabs 186 can engage the free edge 188 of the first bottom panel 120 to interlock the bottom panels (FIG. 2). The second bottom panel 132 can also include an extension 190 extending into each of the second inner openings 154. Alternatively, the first and second bottom panels 120, 132 and the locking features can be omitted or otherwise shaped, arranged, positioned, and/or configured without departing from the disclosure.

An exemplary method of erection of the carrier 105 to form the package 106 is discussed below with reference to FIGS. 2 and 3. As shown in FIG. 2, the outer side panels 112, 124 are folded along respective transverse fold lines 114, 126, and the inner side panels 116, 128 are folded along the respective transverse fold lines 118, 130 to overlay the first bottom panel 120 on the second bottom panel 132. The primary locking tabs 180 can be inserted into the respective locking apertures 182 so that the primary locking tabs 180 engage the tab-receiving edges 184. The free edge 188 of the first bottom panel 120 can be engaged under the secondary locking tabs 186 of the second bottom panel 132. Accordingly, the secondary locking tabs 186 resist withdrawal of the primary locking tabs 180 from the respective locking apertures 182, and the first and second bottom panels 120, 132 are interlocked. Alternatively, bottom panels 120, 132 could be interlocked by other forming steps and features without departing from the disclosure.

In the illustrated embodiment, a container C can be aligned with each of the container-receiving portions 107, 109 with the top surfaces of the lids L in contact with the interlocked bottom panels 120, 130 so that the lids L are generally aligned with the inner retaining features 138, 142. The containers C can be pushed toward the interior 192 of the carrier 105 until the interlocked bottom panels 120, 132 are forced against the top panel 110. As the interlocked bottom panels 120, 132 move towards the top panel 110, the inner side panels 116, 128 and the outer side panels 112, 124 are drawn inwardly against the sides of the containers C, as shown in FIGS. 3-6. The lids L extend through the first and second inner openings 152, 154 and then through the first and second outer openings 144, 146of the respective first and second container-receiving portions 107, 109. The first and second inner side panels 116, 128 at least partially follow the curve of the containers C (FIGS. 5 and 6) and the inner retention flaps 156, 158, 166, 164 engage the body portion B of the containers C. In one embodiment, the inner retention flaps 156, 158, 166, 164 can engage the undersides of the rims R. Additionally, the outer retention tabs 148, 150 can snap under and/or otherwise engage the rims R when the containers C are fully inserted into the respective container-receiving portions 107, 109 (FIG. 3). The curved portions 178 of the outer side panels 112, 124, formed by the arcuate center portions 172, 174 of the respective transverse fold lines 114, 126 and 118, 130, can further help the inner and outer side walls follow the contour of the containers C and securely retain the containers C with the carrier 105. In addition, the curved portions 178 can form a convenient gripping area 176 for grasping and carrying the package 106 (FIG. 3).

Accordingly, in the illustrated embodiment, the containers C can be retained in the carrier 105 without requiring adhesives or other fasteners. Instead, the containers C are supported at the rims R by the inner retention flaps 156, 158, 166, 164 of the inner retention features 138, 142 and the outer retention tabs 148, 150 of the outer retention features 136, 140. Any force tending to pull one or more of the containers C away from the carrier 105 is resisted by the inner retention flaps 156, 158, 166, 164 and the outer retention tabs 148, 150 engaging the rims R. Any force tending to pull one or all of the inner side panels 116, 128 and outer side panels 112, 124 away from the containers C is resisted by the respective bottom panels 120, 132, which are retained between the rims R and the top panel 110. The engagement of the primary locking tabs 180 with the respective locking apertures 182 and secondary locking tabs 186 prevents the bottom panels 120, 132 from moving away from one another. Accordingly, the locking tabs further resist movement of the side panels 112, 116, 124, 128 away from the containers C to further resist opening of the carrier 105. Alternatively, the package 106 can be erected by other forming steps and features without departing from the disclosure. For example, one or more of the panels can be glued together to further help secure the carrier 105 and the containers C in the package 106.

The erected package 106 is shown in FIGS. 3-6. In the illustrated embodiment, the carrier 105 is open-ended, and the side panels 112, 116, 124, 128 extend in a generally oblique direction from the top panel 110. In an alternative embodiment, one or more end panels can be foldably connected to one or more of the top panel 110, the side panels 112, 116, 124, 128, and the bottom panels 120, 132.

Figure 7:
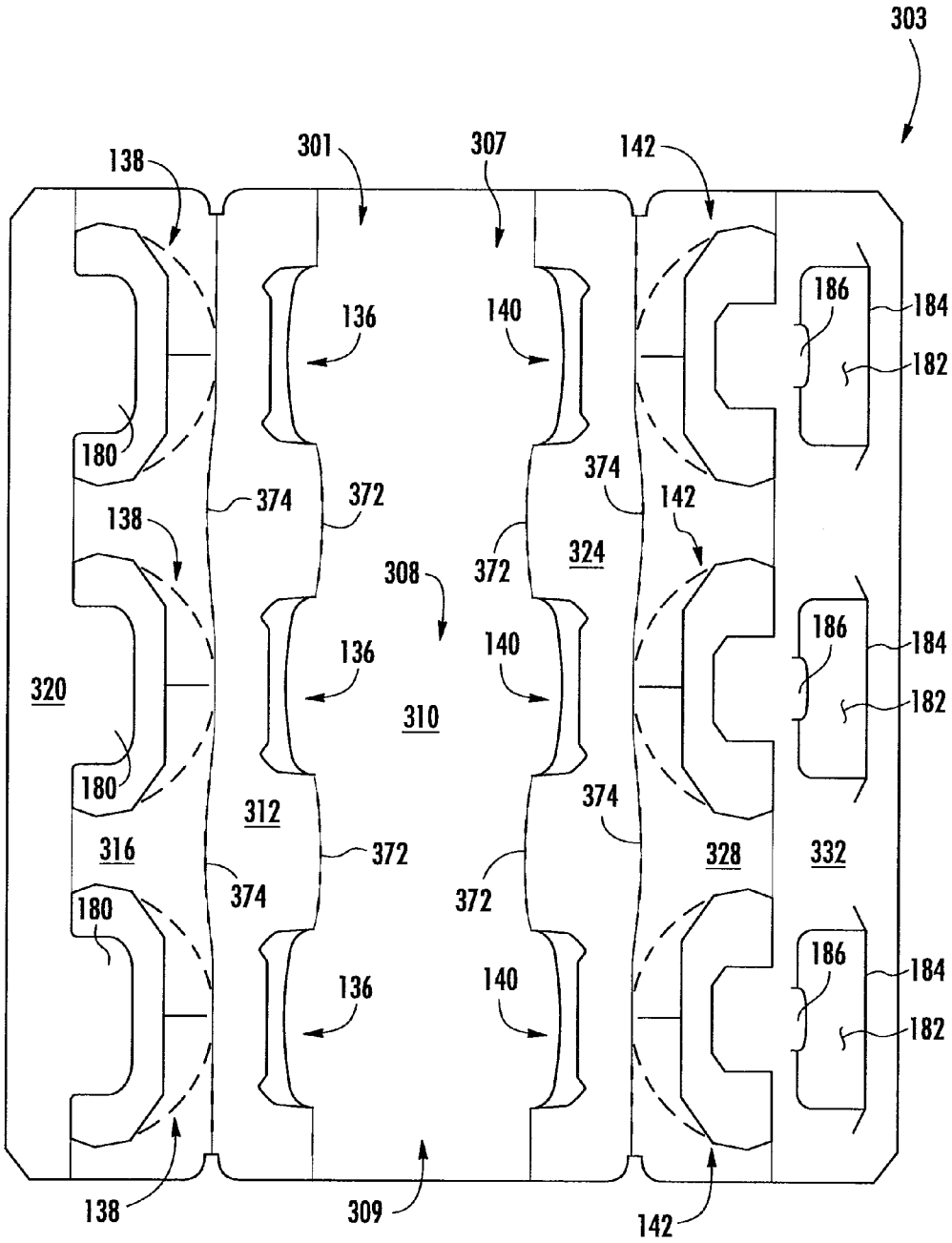
FIG. 7 is a plan view of a blank used to form a carrier according to a second embodiment of the disclosure.
Figure 8:
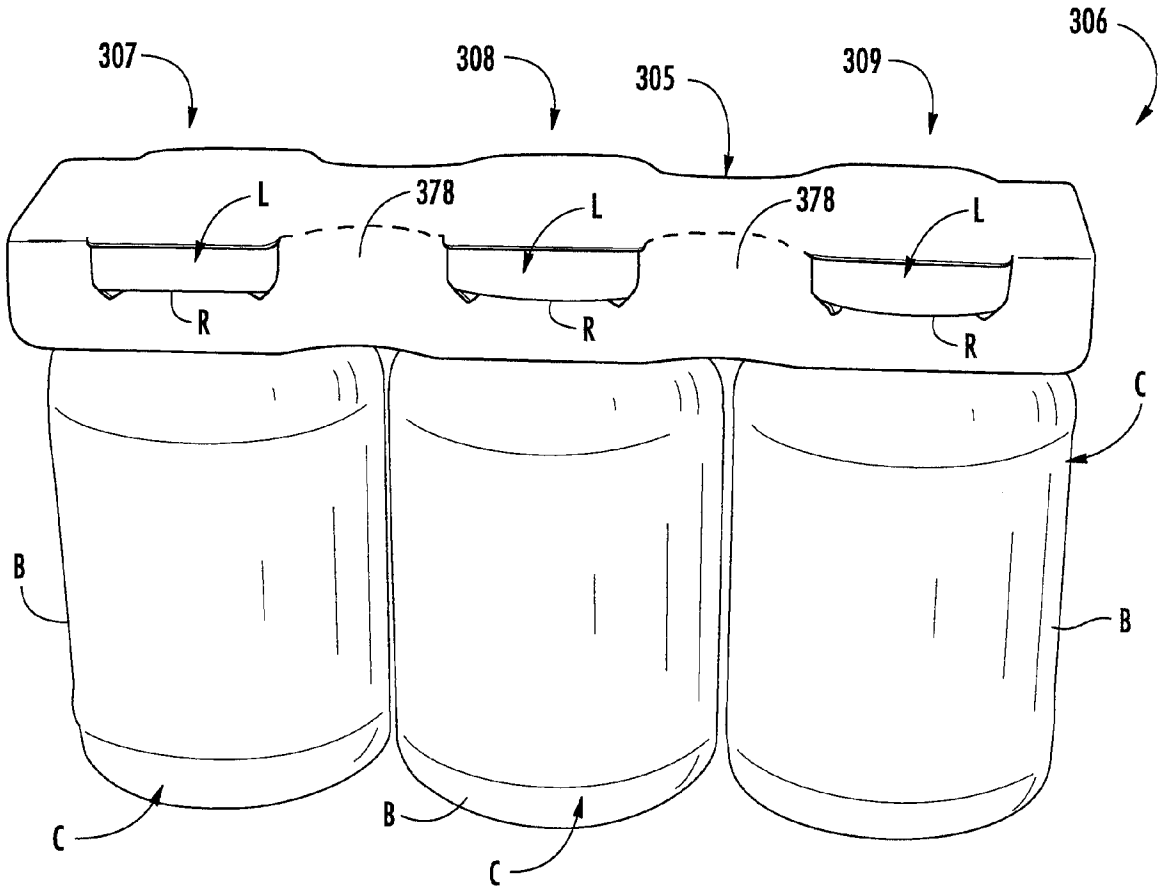
FIG. 8 is a perspective side view of the carrier formed from the blank of FIG. 7 holding containers to form a package according to the second embodiment of the disclosure.

FIG. 7 illustrates an exterior side 301 of a blank 303 for forming a carton or carrier 305 according to a second embodiment of the disclosure. The erected carrier 305 and package 306 are shown in FIG. 8. The second embodiment is generally similar to the first embodiment, except for variations noted and variations that will be apparent to one of ordinary skill in the art. Accordingly, similar or identical features of the embodiments have been given like or similar reference numbers. As shown in FIG. 7, the blank 303 includes three container-receiving portions 307, 308, 309 arranged in a single row. Additionally, the blank 303 includes three primary locking tabs 180, locking apertures 182, and secondary locking tabs 186, each generally aligned with a respective container-receiving portion 307, 308, 309. Alternatively, the locking tabs and apertures can be offset from the container-receiving portions and/or the blank 303 can include a different number of locking tabs and apertures. The package 306 can be assembled in a similar manner as described above with regard to the package 106 of the first embodiment. The assembled carrier 305 can retain three containers C in the respective container-receiving portions 307, 308, 309, as shown in FIG. 8. As shown in FIG. 8, the curved portions 378 formed in the outer side panels 312, 324 are disposed between the first and second container-receiving portions 307, 308, and between the second and third container-receiving portions 308, 309 to help the side panels conform to the shape of the containers C to help retain the containers C in the carrier 305 and to provide a gripping area for grasping and/or carrying the package 306.

The blank 303 and the package 306 can be alternatively configured without departing from the disclosure. For example, the carrier can include any suitable number of container-receiving portions.

Figure 9:
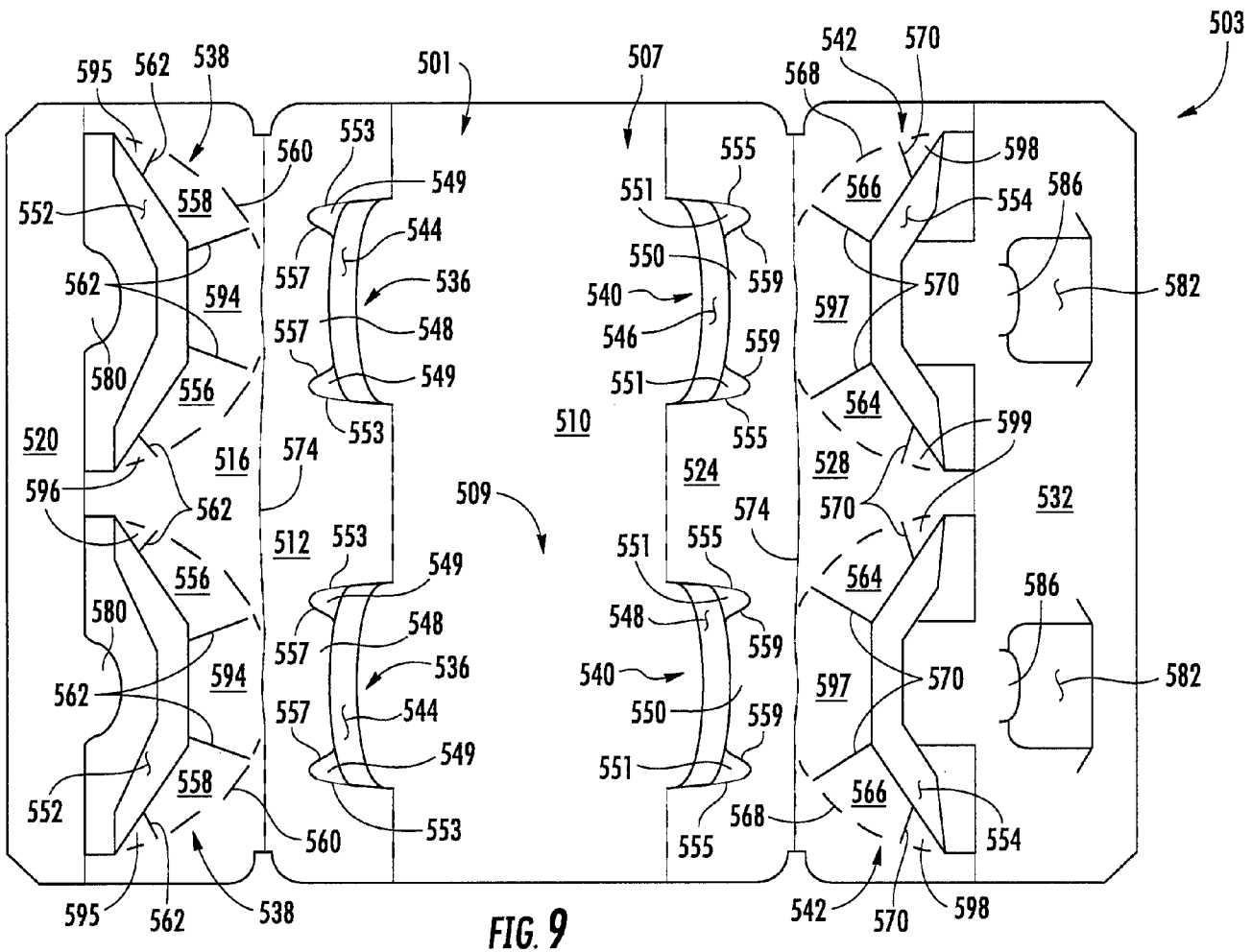
FIG. 9 is a plan view of a blank used to form a carrier according to a third embodiment of the disclosure.
Figure 10:
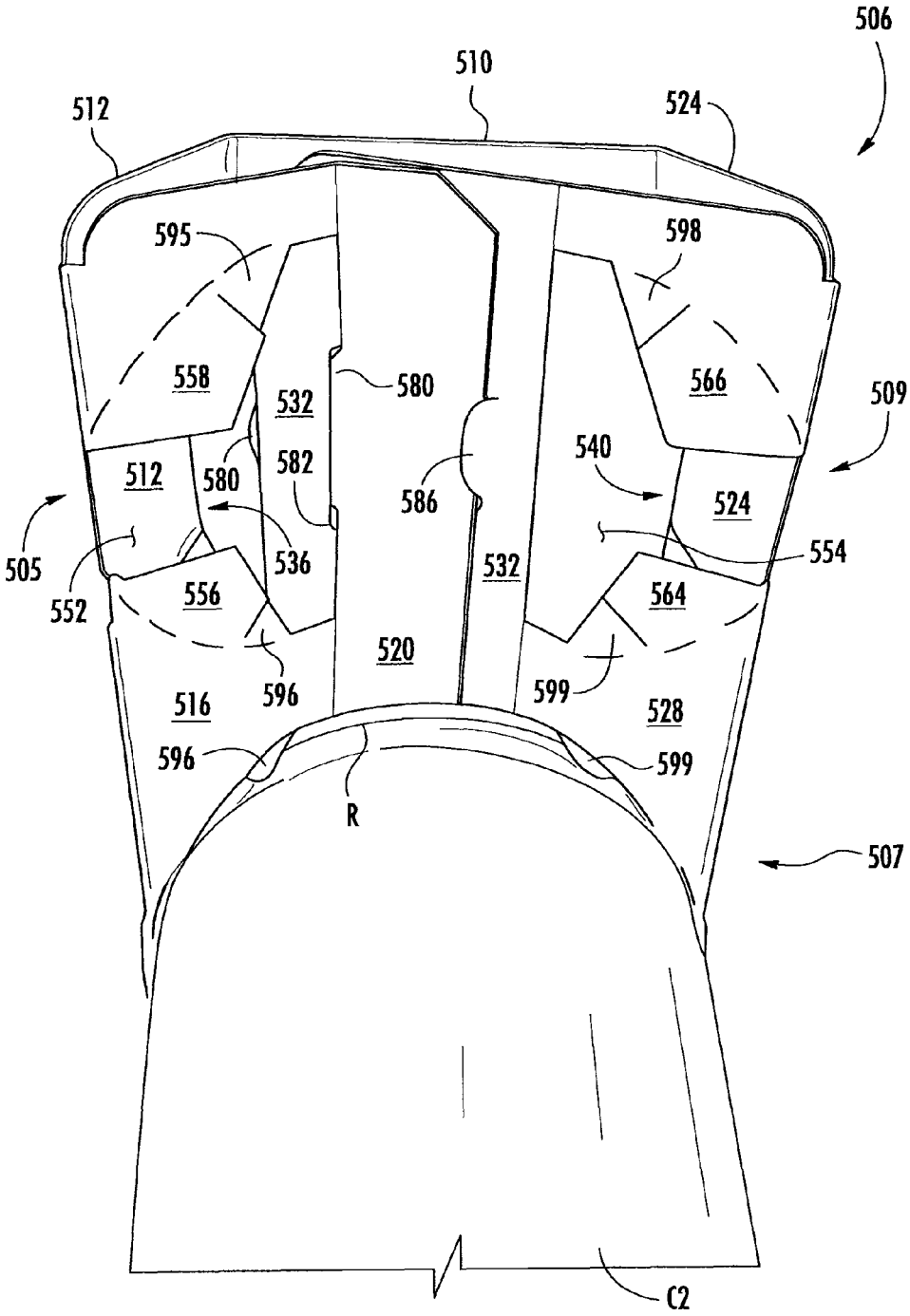
FIG. 10 is a perspective view of an underside of the carrier formed from the blank of FIG. 9 according to the third embodiment of the disclosure.
Figure 11:
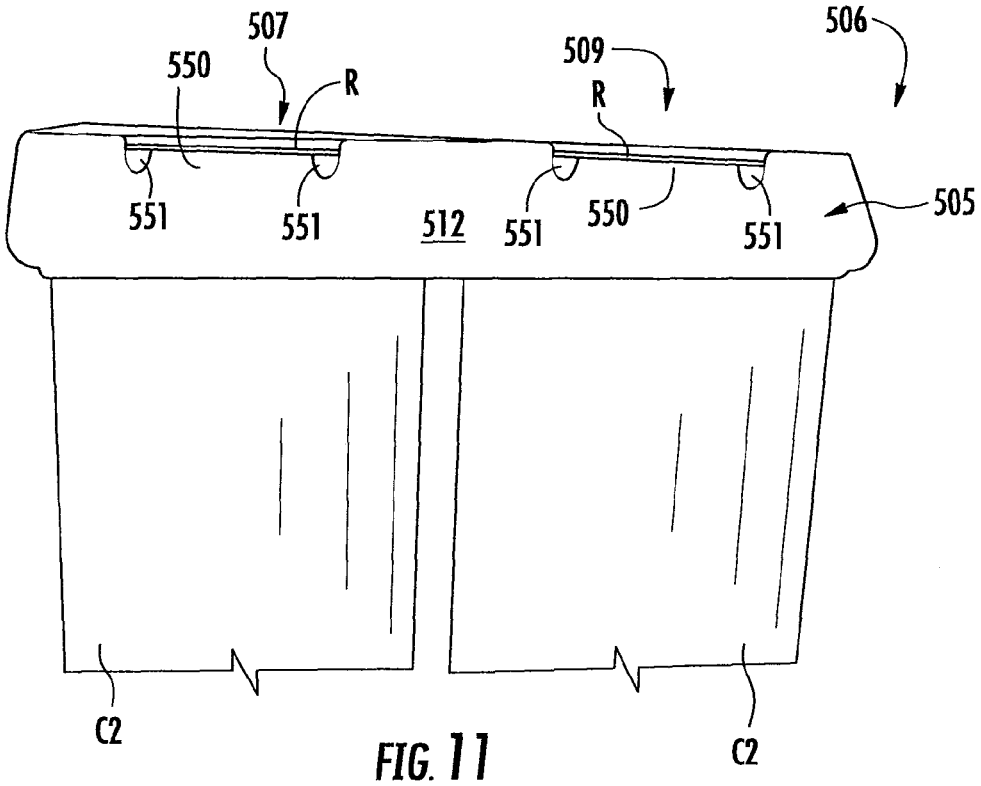
FIG. 11 is a side view of the carrier of FIG. 10 holding containers to form a package according to the third embodiment of the disclosure.
Figure 12:
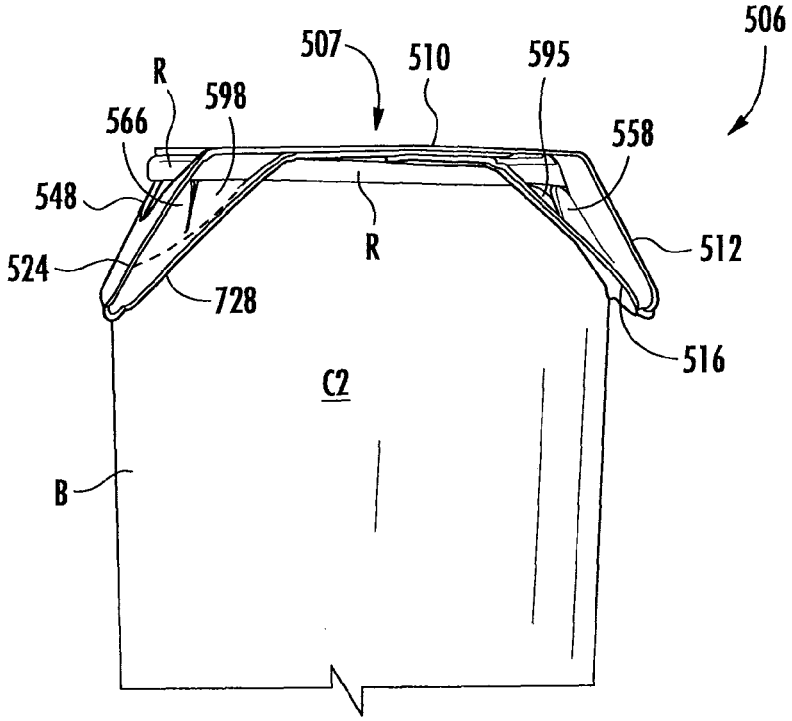
FIG. 12 is a perspective end view of the package of FIG. 11.

FIG. 9 illustrates an exterior side 501 of a blank 503 for forming a carton or carrier 505 (FIGS. 10-12) according to a third embodiment of the disclosure. The erected carrier 505 holding a container C2 (e.g., an aluminum can), forming a package 506 are shown in FIGS. 10-12. The third embodiment is generally similar to the first embodiment, except for variations noted and variations that will be apparent to one of ordinary skill in the art. Accordingly, similar or identical features of the embodiments have been given like or similar reference numbers. As shown in FIG. 9, container-receiving portions 507, 509 of the blank 503 include alternative inner retaining features 538 with five inner retention flaps 556, 558, 594, 595, 596 foldably connected to the inner side panel 516 at arcuate fold lines 560 and defined by cuts 562 and alternative inner retaining features 542 with five inner retention flaps 564, 566, 597, 598, 599 foldably connected to the inner side panel 528 at arcuate fold lines 568 and defined by cuts 570. In one embodiment, the inner retention flaps 594, 597 can be omitted, as shown by way of example in FIG. 10. Additionally, the outer retention features 536, 540 can include a respective outer retention tab 548, 550 configured for engaging the rim R of the containers C2, which can be in the form of a chime. The outer retention features 536, 540 can further include one or more outer retention flaps 549, 551 that are foldably connected to the respective outer side panels 512, 524 along fold lines 553, 555 and are separable from the respective outer retention tabs 548, 550 along cuts 557, 559. The outer retention flaps 549, 551 and the additional inner retention flaps can help the carrier 505 further conform to the shape of the containers C and further resist withdrawal of the containers from the carrier. The blank 503 can be alternatively configured without departing from the disclosure.

In the illustrated embodiment, the package 506 can be assembled in a similar manner as described above with regard to the package 106 of the first embodiment. FIG. 10 shows the underside of the package 506 with one container C2 omitted to show the container-receiving portion 509 from the interior of the carrier 505. FIGS. 11 and 12 show, by way of example, the outer retention tabs 548, 550, the outer retention flaps 549, 551, and the inner retention flaps 558, 566, 595, 598 engaging an underside of the rim R (e.g., the chime of the can). The package 506 can be alternatively configured without departing from the disclosure.

Any of the features of the various embodiments of the disclosure can be combined with, replaced by, or otherwise configured with other features of other embodiments of the disclosure without departing from the scope of this disclosure.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blank may then be coated with a varnish to protect information printed on the blanks. The blank may also be coated with, for example, a moisture barrier layer, on either or both sides of the blanks. The blank can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package comprising a carrier at least partially holding at least a first container and a second container, each of the first container and the second container comprising a top portion and a body portion, the carrier comprising:

a top panel, a first outer side panel foldably connected to the top panel, a first inner side panel foldably connected to the first outer side panel, a second outer side panel foldably connected to the top panel, a second inner side panel foldably connected to the second outer side panel, a first bottom panel foldably connected to the first inner side panel, and a second bottom panel foldably connected to the second inner side panel;

at least a first container receiver and a second container receiver, each of the first container receiver and the second container receiver comprising a first retaining feature extending in at least one of the first inner side panel and the first outer side panel and an opposing second retaining feature extending in at least one of the second inner side panel and the second outer side panel, the top portion of the first container being at least partially retained by the first retaining feature and the second retaining feature of the first container receiver, and the top portion of the second container being at least partially retained by the first retaining feature and the second retaining feature of the second container receiver; and each of the first bottom panel and the second bottom panel is at least partially disposed between the top panel and the top portion of the at least one container;

wherein at least one of the first outer side panel and the second outer side panel comprises a concave curved portion adjacent at least one of the first container receiver and the second container receiver and extending at least partially between the first container receiver and the second container receiver.

2. The package of claim 1, wherein:

the first outer side panel is foldably connected to the top panel along a first fold line, the first inner side panel is foldably connected to the first outer side panel along a second fold line, the second outer side panel is foldably connected to the top panel along a third fold line, and the second inner side panel is foldably connected to the second outer side panel along a fourth fold line;

at least one of the first fold line and the third fold line comprises a first arcuate center portion, and at least one of the second fold line and the fourth fold line comprises a second arcuate center portion, the first arcuate center portion and the second arcuate center portion extending at least partially between the first container receiver and the second container receiver; and the curved portion extends between at least the first arcuate center portion and the second arcuate center portion.

3. The package of claim 1, wherein the first retaining feature of each of the first container receiver and the second container receiver comprises a first outer opening in the first outer side panel and a first outer retention tab adjacent the first outer opening, and the second retaining feature of each of the first container receiver and the second container receiver comprises a second outer opening in the second outer side panel and a second outer retention tab adjacent the second outer opening.

4. The package of claim 3, wherein the first outer opening and the second outer opening are adjacent the top panel, and the first outer retention tab and the second outer retention tab engage an underside of the top portion of the respective first container and second container on opposing sides of the respective container.

5. The package of claim 1, wherein at least one of the first retaining feature and the second retaining feature of each of the first container receiver and the second container receiver comprises:

at least one outer opening in at least one of the first outer side panel and the second outer side panel and at least one retention tab adjacent the at least one outer opening; and at least one inner opening in at least one of the first inner side panel and the second inner side panel and at least one inner retention flap adjacent the at least one inner opening.

6. The package of claim 1, wherein the first bottom panel comprises at least one locking tab, the second bottom panel comprises at least one locking aperture, and the at least one locking tab is at least partially received in the at least one locking aperture.

7. The package of claim 6, wherein the at least one locking tab comprises at least one primary locking tab, the second bottom panel comprises at least one secondary locking tab adjacent the at least one locking aperture, and the at least one secondary locking tab engages a free edge of the first bottom panel opposite to the at least one primary locking tab.

8. The package of claim 6, wherein the at least one locking aperture comprises at least one tab-receiving edge, and a cut extends in the second bottom panel from each end of the at least one tab-receiving edge.

9. A package comprising a carrier at least partially holding at least one container, each container of the at least one container comprising a top portion and a body portion, the carrier comprising:

a top panel, a first outer side panel foldably connected to the top panel, a first inner side panel foldably connected to the first outer side panel, a second outer side panel foldably connected to the top panel, a second inner side panel foldably connected to the second outer side panel, a first bottom panel foldably connected to the first inner side panel, and a second bottom panel foldably connected to the second inner side panel;

at least one container receiver comprising a first retaining feature extending in at least one of the first inner side panel and the first outer side panel and an opposing second retaining feature extending in at least one of the second inner side panel and the second outer side panel, the top portion of the at least one container being at least partially retained by at least one of the first retaining feature and the second retaining feature; and each of the first bottom panel and the second bottom panel is at least partially disposed between the top panel and the top portion of the at least one container;

wherein the first retaining feature of the at least one container receiver comprises a first outer opening in the first outer side panel and a first outer retention tab adjacent the first outer opening, and the second retaining feature of the at least one container receiver comprises a second outer opening in the second outer side panel and a second outer retention tab adjacent the second outer opening;

wherein the first retaining feature of the at least one container receiver comprises at least one first outer retention flap foldably connected to the first outer side panel adjacent the first outer opening and separable from the first outer retention tab by a first cut, and the second retaining feature of the at least one container receiver comprises at least one second outer retention flap foldably connected to the second outer side panel adjacent the second outer opening and separable from the second outer retention tab by a second cut.

10. The package of claim 1, wherein the first retaining feature of each of the first container receiver and the second container receiver comprises a first inner opening in the first inner side panel and at least one first inner retention flap adjacent the first inner opening, and the second retaining feature of each of the first container receiver and the second container receiver comprises a second inner opening in the second inner side panel and at least one second inner retention flap adjacent the second inner opening.

11. The package of claim 10, wherein the at least one first inner retention flap is at least partially defined by a first arcuate fold line in at least the first inner side panel, and the at least one second inner retention flap is at least partially defined by a second arcuate fold line in at least second inner side panel.

12. The package of claim 10, wherein the at least one first inner retention flap comprises at least two first inner retention flaps foldably connected to the first inner side panel adjacent the first inner opening, and the at least one second inner retention flap comprises at least two second inner retention flaps foldably connected to the second inner side panel adjacent the second inner opening, each of the at least two first inner retention flaps and the at least two second inner retention flaps respectfully being at least partially defined by at least one cut.

13. The package of claim 10, wherein the first bottom panel comprises at least one locking tab adjacent the first inner opening of each of the first container receiver and the second container receiver and the second bottom panel comprises at least one locking aperture, the at least one locking tab being at least partially received in the at least one locking aperture.

14. The package of claim 13, wherein the second bottom panel further comprises at least one extension adjacent the inner opening of each of the first container receiver and the second container receiver, the at least one extension being at least partially in face-to-face contact with the top panel.

15. A package comprising a carrier at least partially holding at least one container, each container of the at least one container comprising a top portion and a body portion, the carrier comprising:

a top panel, a first outer side panel foldable connected to the top panel, a first inner side panel foldably connected to the first outer side panel, a second outer side panel foldably connected to the top panel, a second inner side panel foldably connected to the second outer side panel, a first bottom panel foldably connected to the first inner side panel, and a second bottom panel foldable connected to the second inner side panel;

at least one container receiver comprising a first retaining feature extending in at least one of the first inner side panel and the first outer side panel and an opposing second retaining feature extending in at least one of the second inner side panel and the second outer side panel, the top portion of the at least one container being at least partially retained by at least one of the first retaining feature and the second retaining feature; and each of the first bottom panel and the second bottom panel is at least partially disposed between the top panel and the top portion of the at least one container;

wherein the first retaining feature of the at least one container receiver comprises a first inner opening in the first inner side panel and at least one first inner retention flap adjacent the first inner opening, and the second retaining feature of the at least one container receiver comprises a second inner opening in the second inner side panel and at least one second inner retention flap adjacent the second inner opening;

wherein the first retaining feature of the at least one container receiver further comprises a first outer opening in the first outer side panel and a first outer retention tab adjacent the first outer opening, and the second retaining feature of the at least one container receiver further comprises a second outer opening in the second outer side panel and a second outer retention tab adjacent the second outer opening, the first outer opening and the second outer opening being generally aligned with the first inner opening and the second inner opening.

16. The package of claim 15, wherein the top portion of the at least one container is at least partially received in each of the first inner opening and the second inner opening, the at least one first inner retention flap and the second inner retention flap engaging opposite sides of the body portion of the at least one container.

17. The package of claim 16, wherein the top portion of the at least one container is further at least partially received in each of the first outer opening and the second outer opening, the first outer retention tab and the second outer retention tab engaging an underside of opposite sides of the top portion of the at least one container.

18. A blank for forming a carrier for at least partially holding at least a first container and a second container, each of the first container and the second container comprising a top portion and a body portion, the blank comprising:

a top panel, a first outer side panel foldably connected to the top panel along a first fold line, a first inner side panel foldably connected to the first outer side panel along a second fold line, a second outer side panel foldably connected to the top panel along a third fold line, a second inner side panel foldably connected to the second outer side panel along a fourth fold line, a first bottom panel foldably connected to the first inner side panel, and a second bottom panel foldably connected to the second inner side panel; and container receiver features for forming at least a first container receiver and a second container receiver in the carrier formed from the blank, the container receiver features comprising a first retaining feature extending in at least one of the first inner side panel and the first outer side panel and an opposing second retaining feature extending in at least one of the second inner side panel and the second outer side panel for forming the first container receiver in the carrier formed from the blank and a third retaining feature and a fourth retaining feature for forming the second container receiver in the carrier formed from the blank, the first retaining feature and the second retaining feature being for at least partially retaining the top portion of the first container in the carrier formed from the blank;

wherein at least a portion of each of the first bottom panel and the second bottom panel is for being at least partially disposed between the top panel and the top portion of the at least one container when the carrier is formed from the blank;

wherein at least one of the first fold line and the third fold line comprises a first arcuate center portion, and at least one of the second fold line and the fourth fold line comprises a second arcuate center portion, the first arcuate center portion and the second arcuate center portion being for forming a curved portion of at least one of the first outer side panel and the second outer side panel adjacent at least one of the first container receiver and the second container receiver in the carrier formed from the blank;

wherein the first arcuate center portion and the second arcuate center portion extend at least partially between at least one of the first retaining feature and the second retaining feature and a respective one of the third retaining feature and the fourth retaining feature.

19. The blank of claim 18, wherein the first retaining feature comprises a first outer opening in the first outer side panel and a first outer retention tab adjacent the first outer opening, and the second retaining feature comprises a second outer opening in the second outer side panel and a second outer retention tab adjacent the second outer opening.

20. The blank of claim 19, wherein the first outer opening and the second outer opening are adjacent the top panel, and the first outer retention tab and the second outer retention tab are for engaging an underside of the top portion of the first container on opposing sides of the container when the carrier is formed from the blank.

21. The blank of claim 18, wherein the first retaining feature comprises a first inner opening in the first inner side panel and at least one first inner retention flap adjacent the first inner opening, and the second retaining feature comprises a second inner opening in the second inner side panel and at least one second inner retention flap adjacent the second inner opening.

22. The blank of claim 21, wherein the at least one first inner retention flap is at least partially defined by a first arcuate fold line in at least the first inner side panel, and the at least one second inner retention flap is at least partially defined by a second arcuate fold line in at least second inner side panel.

23. The blank of claim 21, wherein the at least one first inner retention flap comprises at least two first inner retention flaps foldably connected to the first inner side panel adjacent the first inner opening, and the at least one second inner retention flap comprises at least two second inner retention flaps foldably connected to the second inner side panel adjacent the second inner opening, each of the at least two first inner retention flaps and the at least two second inner retention flaps respectfully being at least partially defined by at least one cut.

24. The blank of claim 21, wherein the first bottom panel comprises at least one locking tab adjacent the first inner opening of the first retaining feature and the second bottom panel comprises at least one locking aperture, the at least one locking tab for being at least partially received in the at least one locking aperture when the carrier is formed from the blank.

25. The blank of claim 24, wherein the second bottom panel further comprises at least one extension adjacent at least one of the first inner opening of the first retaining feature and the second inner opening of the second retaining feature, the at least one extension for being disposed at least partially in face-to-face contact with the top panel when the carrier is formed from the blank.

26. The blank of claim 18, wherein at least one of the first retaining feature and the second retaining feature comprises:

at least one outer opening in at least one of the first outer side panel and the second outer side panel and at least one retention tab adjacent the at least one outer opening; and at least one inner opening in at least one of the first inner side panel and the second inner side panel and at least one inner retention flap adjacent the at least one inner opening.

27. The blank of claim 18, wherein the first bottom panel comprises at least one primary locking tab and the second bottom panel comprises at least one locking aperture and at least one secondary locking tab adjacent the at least one locking aperture, the at least one primary locking tab is at least partially received in the at least one locking aperture and the at least one secondary locking tab engages a free edge of the first bottom panel opposite to the at least one primary locking tab when the carrier is formed from the blank.

28. The blank of claim 27, wherein the at least one locking aperture comprises at least one tab-receiving edge, and a cut extends in the second bottom panel from each end of the at least one tab-receiving edge.

29. A blank for forming a carrier for at least partially holding at least one container, each container of the at least one container comprising a top portion and a body portion, the blank comprising:

a top panel, a first outer side panel foldably connected to the top panel, a first inner side panel foldably connected to the first outer side panel, a second outer side panel foldably connected to the top panel, a second inner side panel foldably connected to the second outer side panel, a first bottom panel foldably connected to the first inner side panel, and a second bottom panel foldably connected to the second inner side panel; and container receiver features for forming at least one container receiver in the carrier formed from the blank, the container receiver features comprising a first retaining feature extending in at least one of the first inner side panel and the first outer side panel and an opposing second retaining feature extending in at least one of the second inner side panel and the second outer side panel, at least one of the first retaining feature and the second retaining feature being for at least partially retaining the top portion of the at least one container in the carrier formed from the blank;

wherein at least a portion of each of the first bottom panel and the second bottom panel is for being at least partially disposed between the top panel and the top portion of the at least one container when the carrier is formed from the blank;

wherein the first retaining feature comprises a first outer opening in the first outer side panel and a first outer retention tab adjacent the first outer opening, and the second retaining feature comprises a second outer opening in the second outer side panel and a second outer retention tab adjacent the second outer opening;

wherein the first retaining feature comprises at least one first outer retention flap foldably connected to the first outer side panel adjacent the first outer opening and separable from the first outer retention tab by a first cut, and the second retaining feature comprises at least one second outer retention flap foldably connected to the second outer side panel adjacent the second outer opening and separable from the second outer retention tab by a second cut.

30. A blank for forming a carrier for at least partially holding at least one container, each container of the at least one container comprising a top portion and a body portion, the blank comprising:

a top panel, a first outer side panel foldably connected to the top panel, a first inner side panel foldably connected to the first outer side panel, a second outer side panel foldably connected to the top panel, a second inner side panel foldably connected to the second outer side panel, a first bottom panel foldably connected to the first inner side panel, and a second bottom panel foldably connected to the second inner side panel; and container receiver features for forming at least one container receiver in the carrier formed from the blank, the container receiver features comprising a first retaining feature extending in at least one of the first inner side panel and the first outer side panel and an opposing second retaining feature extending in at least one of the second inner side panel and the second outer side panel, at least one of the first retaining feature and the second retaining feature being for at least partially retaining the top portion of the at least one container in the carrier formed from the blank;

wherein at least a portion of each of the first bottom panel and the second bottom panel is for being at least partially disposed between the top panel and the top portion of the at least one container when the carrier is formed from the blank;

wherein the first retaining feature comprises a first inner opening in the first inner side panel and at least one first inner retention flap adjacent the first inner opening, and the second retaining feature comprises a second inner opening in the second inner side panel and at least one second inner retention flap adjacent the second inner opening;

wherein the first retaining feature further comprises a first outer opening in the first outer side panel and a first outer retention tab adjacent the first outer opening, and the second retaining feature further comprises a second outer opening in the second outer side panel and a second outer retention tab adjacent the second outer opening, the first outer opening and the second outer opening being generally aligned with the first inner opening and the second inner opening.

31. A method of forming a package, comprising:

obtaining a blank comprising a top panel, a first outer side panel foldably connected to the top panel along a first fold line, a first inner side panel foldably connected to the first outer side panel along a second fold line, a second outer side panel foldably connected to the top panel along a third fold line, a second inner side panel foldably connected to the second outer side panel along a fourth fold line, a first bottom panel foldably connected to the first inner side panel, a second bottom panel foldably connected to the second inner side panel, and container receiver features comprising a first retaining feature extending in at least one of the first inner side panel and the first outer side panel and an opposing second retaining feature extending in at least one of the second inner side panel and the second outer side panel, wherein at least one of the first fold line and the third fold line comprises a first arcuate center portion, and at least one of the second fold line and the fourth fold line comprises a second arcuate center portion; and forming a carrier having an interior and at least one container receiver by folding the blank so that the first bottom panel and the second bottom panel are at least partially overlapped opposite to the top panel and folding the first outer side panel and the second outer side panel to extend generally downwardly with respect to the top panel, the at least one container receiver comprising the first retaining feature and the second retaining feature, wherein the folding the first outer side panel and the second outer side panel comprises forming a curved portion in at least one of the first outer side panel and the second outer side panel adjacent the at least one container receiver, the curved portion extending between the first arcuate center portion and the second arcuate center portion;

positioning at least one container to be respectfully received in the at least one container receiver with at least a portion of the first bottom panel and the second bottom panel being disposed between the top panel and a top portion of the at least one container, the positioning the at least one container comprises folding the first inner side panel and the second inner side panel so that the first bottom panel and the second bottom panel are at least partially in face-to-face contact with the top panel and the first inner side panel and the second inner side panel extend generally upwardly from the respective first outer sidepanel and second outer side panel to the respective first bottom panel and second bottom panel.

32. The method of claim 31, wherein the first retaining feature comprises a first inner opening in the first inner side panel and at least one first inner retention flap adjacent the first inner opening, and the second retaining feature comprises a second inner opening in the second inner side panel and at least one second inner retention flap adjacent the second inner opening.

33. The method of claim 32, wherein:

the first retaining feature further comprises a first outer opening in the first outer side panel and a first outer retention tab adjacent the first outer opening, and the second retaining feature further comprises a second outer opening in the second outer side panel and a second outer retention tab adjacent the second outer opening, the first outer opening and the second outer opening being generally aligned with the first inner opening and the second inner opening; and the positioning the at least one container comprising inserting a first portion of a top portion of the at least one container through the first inner opening and the first outer opening and a second portion of the top portion of the at least one container through the second inner opening and the second outer opening, at least a portion of the first outer retention tab engaging the top portion of the at least one container and at least a portion of the second outer retention tab engaging the top portion of the at least one container.

* * * * *